US006439001B1

(12) United States Patent
Schaffer

(10) Patent No.: US 6,439,001 B1
(45) Date of Patent: Aug. 27, 2002

(54) LATCH NEEDLE HAVING A RESILIENT LATCH SUPPORT

(75) Inventor: Oskar Schaffer, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/972,931

(22) Filed: Oct. 10, 2001

(30) Foreign Application Priority Data

Oct. 14, 2000 (DE) ..... 100 51 029

(51) Int. Cl.[7] ..... D04B 35/04
(52) U.S. Cl. ..... 66/121
(58) Field of Search ..... 66/116, 121, 122, 66/123

(56) References Cited

U.S. PATENT DOCUMENTS 3,050,968 A * 8/1962 Masujima ..... 66/61
4,791,794 A * 12/1988 Schmoll ..... 66/121
4,827,739 A * 5/1989 Goller et al. ..... 66/64
5,239,844 A * 8/1993 Sos ..... 66/121
5,956,976 A * 9/1999 Schaffer et al. ..... 66/121

FOREIGN PATENT DOCUMENTS

| | | |
|---|---|---|
| DE | 1821388 | 8/1960 |
| DE | 1841496 | 9/1961 |
| DE | 1113537 | 10/1967 |
| DE | 1410312 | 4/1969 |
| GB | 768051 | 2/1957 |

* cited by examiner

*Primary Examiner*—Danny Worrell
(74) *Attorney, Agent, or Firm*—Venable; Gabor J. Kelemen

(57) ABSTRACT

A latch needle includes a needle shank; a hook formed at one end of the needle shank; a saw slot formed in the needle shank adjacent the hook; and a latch supported in the saw slot for pivotal motion about a pivot axis. The latch has first and second end positions and a position of rest situated between the end positions adjacent one of the end positions. Further, the latch has first and second engagement faces spaced from one another. A spring situated in the saw slot has a first pressing face which is in contact with the first engagement face when the latch is in the position of rest; and a second pressing face spaced from the first pressing face and being in contact with the second engagement face when the latch is in the end position adjacent the position of rest.

16 Claims, 8 Drawing Sheets

LATCH NEEDLE HAVING A RESILIENT LATCH SUPPORT

CROSS-REFERENCE TO RELATED APPLICATION

This application claims the priority of German Application No. 100 51 029.9, filed Oct. 14, 2000 which is incorporated herein by reference.

BACKGROUND OF THE INVENTION

This invention relates to a latch needle, particularly for use in knitting machines.

Knitting machine needles are used in great numbers in flat bed knitting machines, as well as circular knitting machines. The latch needles have a needle shank which, at one end, terminates in a hook (needle head). A pivotally supported latch cooperates with the hook and may swing back and forth between two end positions. In one end position the latch lies with its noucat (latch spoon) against the hook tip and thus closes the inner hook space. In its other end position the latch is in a reverse orientation and thus opens the inner hook space.

In some knitting machines it is desired to maintain the needle latch in a stable position of rest in the vicinity of the respective two end positions. Thus, for example, only one staple end position for the latch may be desired which is in the vicinity of the reverse end position and in which the latch is not in contact with the the needle shank. It is an exemplary purpose of such an arrangement that the thread of a loop which closes the latch may glide in the intermediate space between the latch and the needle shank without being impaled by the tip of the latch (latch spoon).

Occasionally, it may also be required that the latch assume a stable position of rest adjacent the closed end position. This is the case, for example, when the latch is guided from its closed position into its reverse, open position by a brush carried by the knitting machine. The brush may better engage the latch if the latter is slightly spaced from the hook. In any event, however, the latch must not have an excessive distance from the hook to securely avoid damaging of the latch. By moving the latch from its closed position into its reverse position, the thread trapping since is opened and thus a thread for forming a loop may be inserted.

Springs are used for setting the stable positions of rest of the latch. For example, U.S. Pat. No. 3,050,968 describes a latch needle having a needle shank, a hook provided at one shank end and a pivotally supported latch disposed adjacent the hook. The latch projects, with the latch shank, into a saw slot which is traversed by a bearing pin. The bearing pin pivotally supports the latch for swinging motion between a closed end position in which the latch engaged the hook end with the latch spoon and a reverse end position in which the inner hook space is open. In the saw slot a flexion spring is positioned which engages the end of the latch shank. The end of the latch shank has a flattened region which serves as an engagement face and which is contacted by a pressing face of the spring. This arrangement determines a stable position of rest of the latch in which the latch spoon is slightly spaced from the hook tip.

It has been found to be very difficult to apply by a flexion spring of the above-outlined type the relatively large resetting force needed for lifting the latch off the hook tip.

Further, latch needles having spring-supported latches are known, such as shown in FIGS. 7 and 8. The latch needle 1 has a needle shank 2 terminating in a hook 3 having a hook tip 4. The hook 3 is adjoined by a shank region in which a latch slot which is synonymously a saw slot 5 is formed. A latch 6 is pivotally supported in the saw slot 5 by a bearing pin 7. A leaf spring 8 positioned in the saw slot 5 has spring ends 11 and 12 which engage respective seats 14 and 10 formed in the saw slot 5. The spring 8 has flexing locations 15 and 16 on either side of the bearing pin 7. The flexing locations 15, 16, as shown in FIG. 7, may contact the reverse side 17 of the latch 6 as shown in FIG. 7 or may contact an inner side 18 of the latch 6 as shown in FIG. 8. Thus, the flexing locations 15, 16 form pressing faces.

In such a basic construction the position of rest of the latch 6 set by the flexion spring 8 is essentially dependent from the positioning of the bearing pin 7 relative to the flexing locations 15 and 16. The smallest tolerances in the making of the spring 8 or the bearing pin 7 substantially affect the position of rest of the latch 6. A tolerance in the position of the bearing pin 7 in the longitudinal direction of the latch needle 1 also results in a significant error in the position of rest of the latch 6. It is a disadvantageous result of these circumstances that in case that latch 6 is in its reverse end position, a thread, during the return motion of the latch needle 1, may be impaled by the latch spoon or, when the latch is in its closed end position, the brushes may not arrive in contact therewith. Therefore, a proper functioning of the latch needle is not ensured.

In addition, a tolerance in the position of the bearing pin 7 between the needle back 9 and the check 19 results in a significant deviation of the resetting forces from their optimal value. If the resetting forces are too small, the latch cannot be moved into its positions of rest, whereas in case the resetting forces are too large, the latch swings beyond the positions of rest and may be damaged. Again, a reliable operation of the latch needle cannot be ensured.

The position of the latch in its respective position of rest and the force with which the latch is moved and retained in such a position of rest affect the quality of the loops of the knit fabric.

SUMMARY OF THE INVENTION

It is an object of the invention to provide an improved latch needle of the above-outlined type for obtaining an ameliorated knit fabric.

This object and others to become apparent as the specification progresses, are accomplished by the invention, according to which, briefly stated, the latch needle includes a needle shank; a hook formed at one end of the needle shank; a saw slot formed in the needle shank adjacent the hook; and a latch supported in the saw slot for pivotal motion about a pivot axis. The latch has first and second end positions and a position of rest situated between and end positions adjacent one of the end positions. Further, the latch has first and second engagement faces spaced from one another. A spring situated in the saw slot has a first pressing face which is contact with the first engagement face when the latch is in the position of rest and a second pressing face spaced from the first pressing face. The second pressing face is in contact with the second engagement face when the latch is in the end position adjacent the position of rest.

Thus, the latch needle according to the invention has a spring, determining for the needle latch at least one stable position of rest which is different from an end position. Two engagement faces forming part of the latch and two pressing faces forming part of the spring are provided for this purpose. As a result of this arrangement a position of rest for the latch may be set by the cooperation between the first pressing face and the first engagement face and also, the latch may be moved out from its adjoining end position. For example, the latch may be lifted off the hook by the cooperation between the second engagement face and the second pressing face. This has the advantage that lifting the latch off the hook may be effected by means of a relatively large resetting torque, while the setting of the position of rest may occur with a lesser resetting torque. This, on the one hand, ensures a reliable, secure lifting of the latch off the hook and, on the other hand, a loop gliding over the latch may very easily press the latch against the hook. This occurs at least as long as the latch is exposed to a larger counter torque in the vicinity of its end position. Therefore, the latch has a much lesser tendency to expand the loop sliding thereon than in the prior art arrangement of FIGS. 7 and 8 in which a single engagement face and a single pressing face cause the latch to move from its end position into the respective position of rest.

Further, the latch needle according to the invention is significantly less sensitive to manufacturing tolerances than the conventional latch needle shown in FIGS. 7 and 8. The stable portion of rest is set by the first pressing face and the first engagement face; the first engagement face is preferably arranged at the end of the latch shank. The pressing face of the spring extends preferably parallel to the spring length, that is, parallel or at a small acute angle to an imaginary line which connects the two ends of the spring. In this manner the effect of manufacturing tolerances during flexing of the spring or its positioning relative to the latch in the saw slot is substantially suppressed.

In the latch needle according to the invention the pressing and engagement faces for moving the latch out of its end positions are separated from those pressing and engagement faces which serve for maintaining the latch in a position of rest. As a result, the latch may be held in its position of rest with relatively small resetting forces. This prevents the latch from snapping into its stable position of rest with an excessive force and thus with an excessive speed which would likely lead to overshooting its desired position. Such instances which may occur in conventional needles and may lead to a defective loop formation or even to needle or latch damage, are substantially avoided by the latch needle according to the invention.

The latch needle according to the invention is advantageously so configured that the first pressing face and the first engagement face are out of contact with one another when the latch is situated in its end position and further, the second pressing face and the second engagement face are out of contact with one another when the latch is in its position of rest. This measure separates the motion ranges of the latch in which the first or, as the case may be, the second engagement face/pressing face pair is effective. This arrangement allows to set the resetting torques of the latch independently from one another for the respective motion ranges.

Advantageously, the distance of the first engagement face of the latch from the pivotal latch axis is less than such distance of the second engagement face. This results in relatively large but short-stroke resetting torques applied to the second engagement face. Such large resetting torques ensure a particularly reliable lifting of the latch from the hook and, because of their short stroke, they contribute only inappreciably, if at all, to an expansion of the loops.

The first engagement face is preferably so arranged that, together with the pivotal latch axis, it defines a triangle whose angles adjoining the engagement face are acute angles. As a result, each pivotal motion of the latch from its position of rest tensions the spring, whereby the positions of rest in both pivotal directions are set in a stable manner. This too, contributes to an accurate setting of the position of rest of the latch.

In a preferred embodiment of the invention the pivotal range in which the second pressing face is in an operating engagement with the second engagement face (that is, there is an at least linear or spot contact) is smaller than the pivotal range in which the first engagement face (or its shank-side or terminal edge) is in engagement with the first pressing face.

The first engagement face is preferably planar. In the alternative, however, it may be concave or convex. The engagement face functions as a cam face. Configuring the engagement face as a planar surface has the advantage that the desired position of rest may be accurately set.

The latch needle according to the invention may also be so constructed that the latch has two defined, stable positions of rest adjoining its respective end positions. For this purpose third and fourth engagement faces are provided on the latch, and third and fourth pressing faces are provided on the spring. The pressing faces, particularly the first and third pressing faces, may be identical or may at least partially overlap one another, that is, they enclose a common surface region.

It has been found that the dimension of the pressing faces measured in the longitudinal spring direction is expediently at least twice the spring thickness. This ensures a sufficient stability of the desired position of rest.

DESCRIPTION OF THE PREFERRED EMBODIMENT

Figure 1:
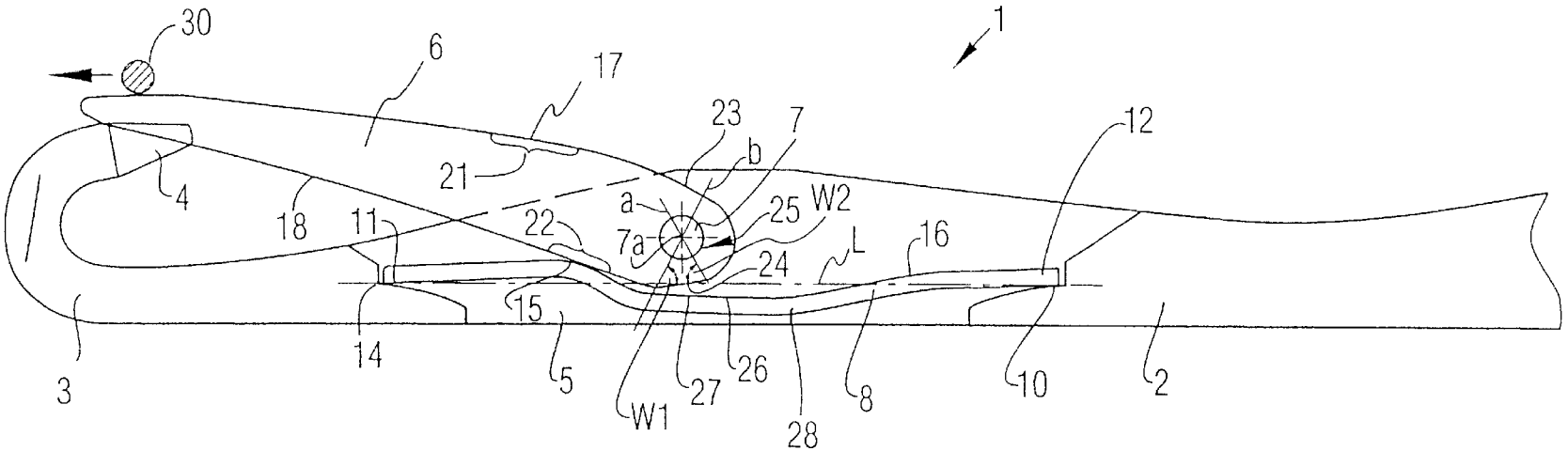
FIG. 1 is a fragmentary schematic sectional side elevational view of a latch needle according to the invention, showing the latch in the closed end position.

FIG. 1 illustrates a latch needle 1 having a shank 2 which at one end has a hook 3 terminating in a hook tip 4. In the shank 2, adjacent the hook 3, a saw slot 5 is formed in which a latch 6 is pivotally supported, for example, by an approximately cylindrical bearing pin 7. The bearing pin 7 defines a pivotal axis 7*a,* approximately coinciding with the central pin axis.

The latch 6 cooperates with a flexion spring 8 which is disposed in the saw slot 5 and which extends past the bearing pin 7. The two opposite spring ends 11 and 12 and supported in respective seats 14 and 10 formed in the saw slot 5. The spring 8 which extends in a longitudinal direction designated with a dash dot line L, has two flexing locations 15 and 16 formed by curved spring portions. The flexing locations 15, 16 constitute pressing faces, which, respectively, contact a planar engagement face 22 of the inner edge 18 and a planar engagement face 21 of the outer (reverse) edge 17 of the latch 6 as the latter assumes its respective closed and open (reverse) end positions.

In addition to the engagement faces 21, 22, the latch 6 has further engagement faces 23, 24 which are arranged at that end of the latch 6 which projects into the saw slot 5. That latch end has an opening 25 for the passage of the bearing pin 7.

Two essentially planar pressing faces 26, 27 of the spring 8 cooperate with the respective engagement faces 23, 24 of the latch 6. The pressing faces 26, 27 are situated between the flexing locations 15, 16 and, as may be seen in FIG. 1, are positioned underneath the line L which interconnects the engagement points of the spring ends 11, 12 with the respective seats 14, 10 in the saw slot 5. The flexing locations 15, 16 are positioned above the line L.

Figure 2:
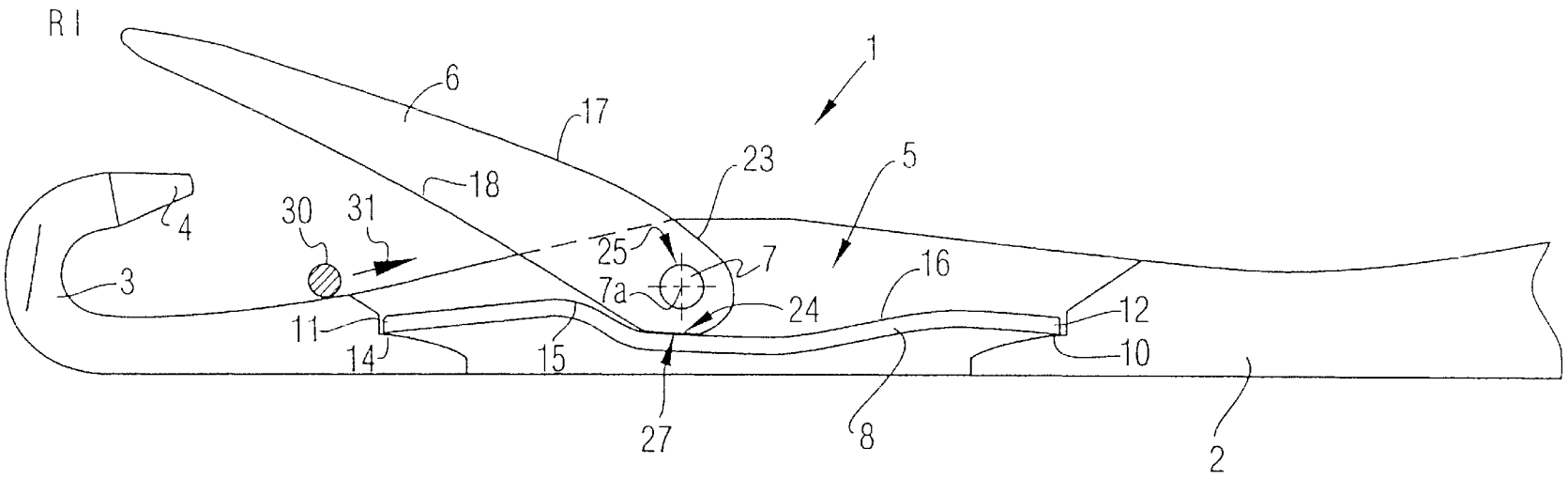
FIG. 2 is a view similar to FIG. 1, showing the latch in a first stable position of rest.
Figure 3:
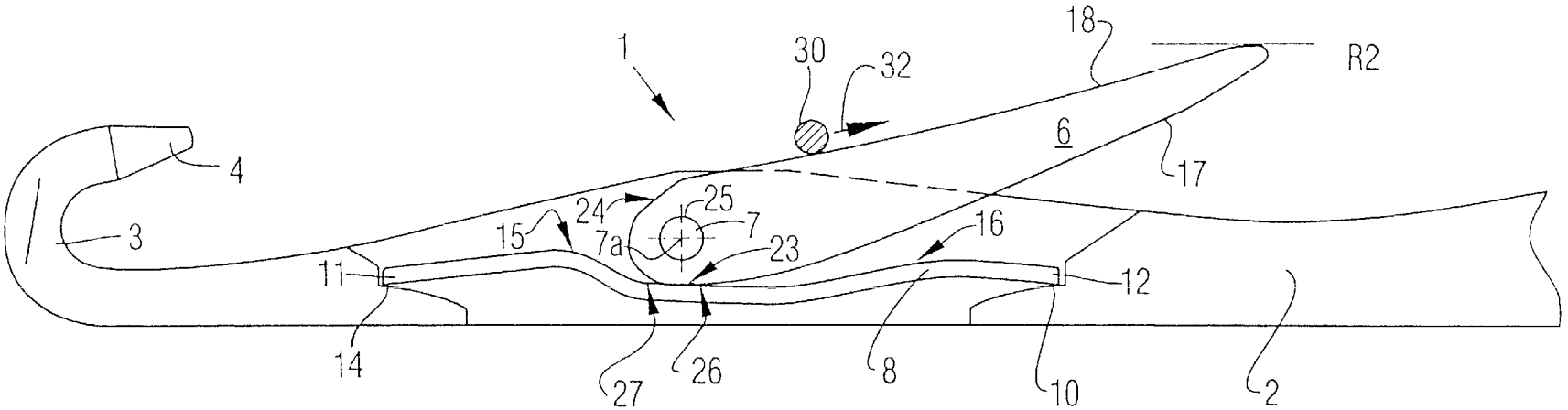
FIG. 3 is a view similar to FIG. 1, showing the latch in a second stable position of rest.

Thus, the spring 8 has a dual bend which has such a flatness that the pressing faces formed by the flexing locations 15, 16 do not contact the engagement faces 21, 22 when the pressing face 26 and 27 is in contact with the engagement face 23 or 24, as may be seen, for example, in FIGS. 2 and 3. The lengths of the pressing faces 26, 27 are, measured in the length dimension of the needle, preferably approximately two to three times longer than the thickness of the spring 8.

The engagement faces 23, 24 are arranged in such a manner at the end of the latch shank that they define a triangle with the pivotal axis 7*a*. The triangle has two acute angles as shown in FIG. 1. Thus, if the two opposite ends of the engagement face 24 are connected by lines a and b with the pivotal axis 7*a,* a triangle is obtained in which the angles W1 and W2 formed between the connecting lines a, b and the engagement face 24 are smaller than 90°. The purpose of this measure is to stabilize the desired position of rest of the latch 6 in both pivotal directions by means of resetting torques.

Figure 4:
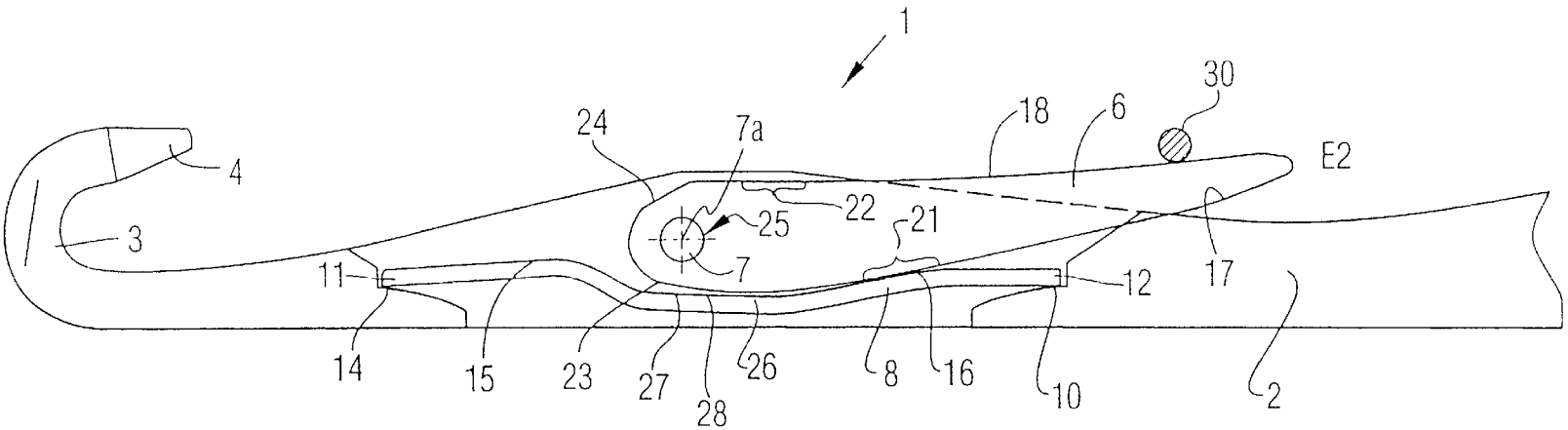
FIG. 4 is a view similar to FIG. 1, showing the latch in its reverse (open) end position.

The pressing faces 26, 27 may adjoin or may overlap one another, as shown in FIG. 4. They are defined by the regions of a flat central length portion 28 of the spring 8 which are in contact with the respective engagement faces 23, 24 of the latch 6 in certain pivotal positions thereof. The flat central length portion 28 of the spring 8 is situated underneath the bearing pin 7. The distance between the engagement faces 23, 24 and the opening 25 is preferably smaller than the diameter of the pin 7. The engagement faces 21, 22 defined by the flexing locations 15, 16 on the other hand, are arranged at a greater distance from the bearing pin 7.

Figure 5:
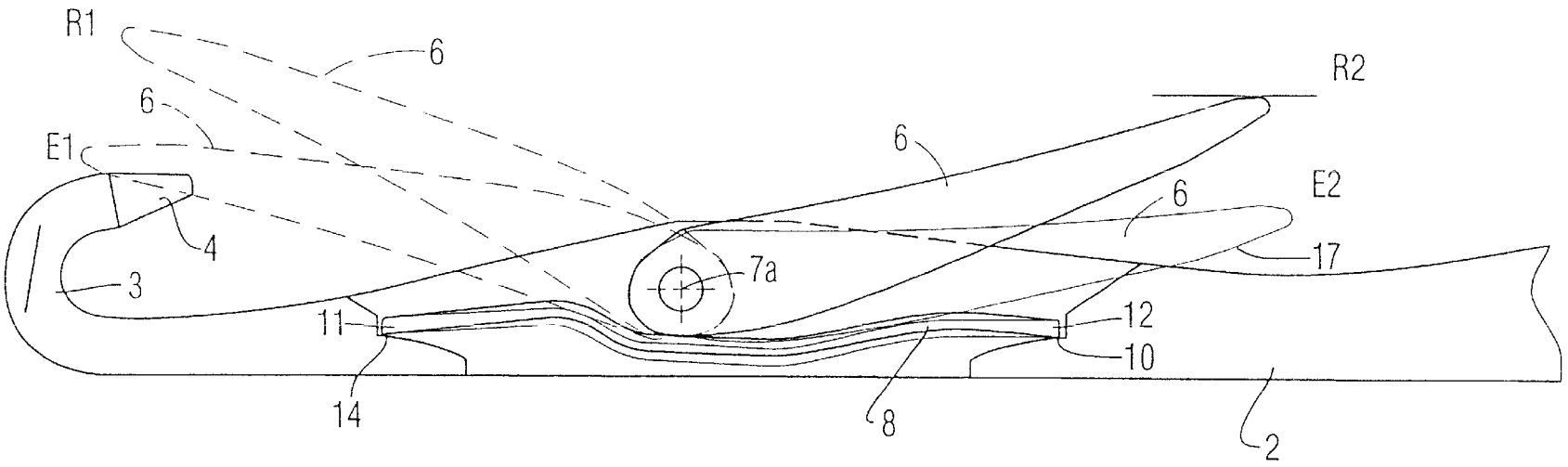
FIG. 5 is a view similar to FIG. 1, illustrating all the different latch positions depicted in FIGS. 1–4.

The spring 8 defines, in cooperation with the latch 6, two stable positions of rest, R1, R2 which are shown in FIG. 5 and in which the latch 6 is out of contact with the flexing locations 15, 16 of the spring 8.

The latch 6 is pivotal between two end positions E1, E2. The end position E1 which is the closed position of the latch 6, is defined by the engagement between the latch spoon and the hook tip 4. The end position E2 which is the extreme reverse position of the latch 6, is defined by the engagement between the outer edge 17 of the latch 6 and the shank 2.

The two positions of rest R1, R2 are pivotal positions which are situated between the two end positions E1, E2. The position of rest R1 is a latch position in which the latch 6 has been lifted off the hook tip 4. The position of rest R2 is a latch position in which the latch 6 is in the vicinity of the end position E2 and has been lifted off the needle shank 2. In the position of rest R2 the clearance between the latch 6 and the shank 2 is such that a thread, which is moved from the shank 2 in the direction of the hook 3, may glide into the gap between the latch 6 and the shank 2 which are oriented at an acute angle to one another.

In the description which follows, the operation of the above-described latch needle 1 will be set forth.

As shown in FIG. 2, a thread 30, belonging to a loop, lies within the inner hook space of the latch needle 1. The latch 6 is situated in its position of rest R1. Such a position is reached and defined as the spring 8, with its pressing face 27, contacts the engagement face 24 under bias. The engagement face 24 is designated as a "first engagement face" and the pressing face 27 is designated as a "first pressing face".

Figure 6:
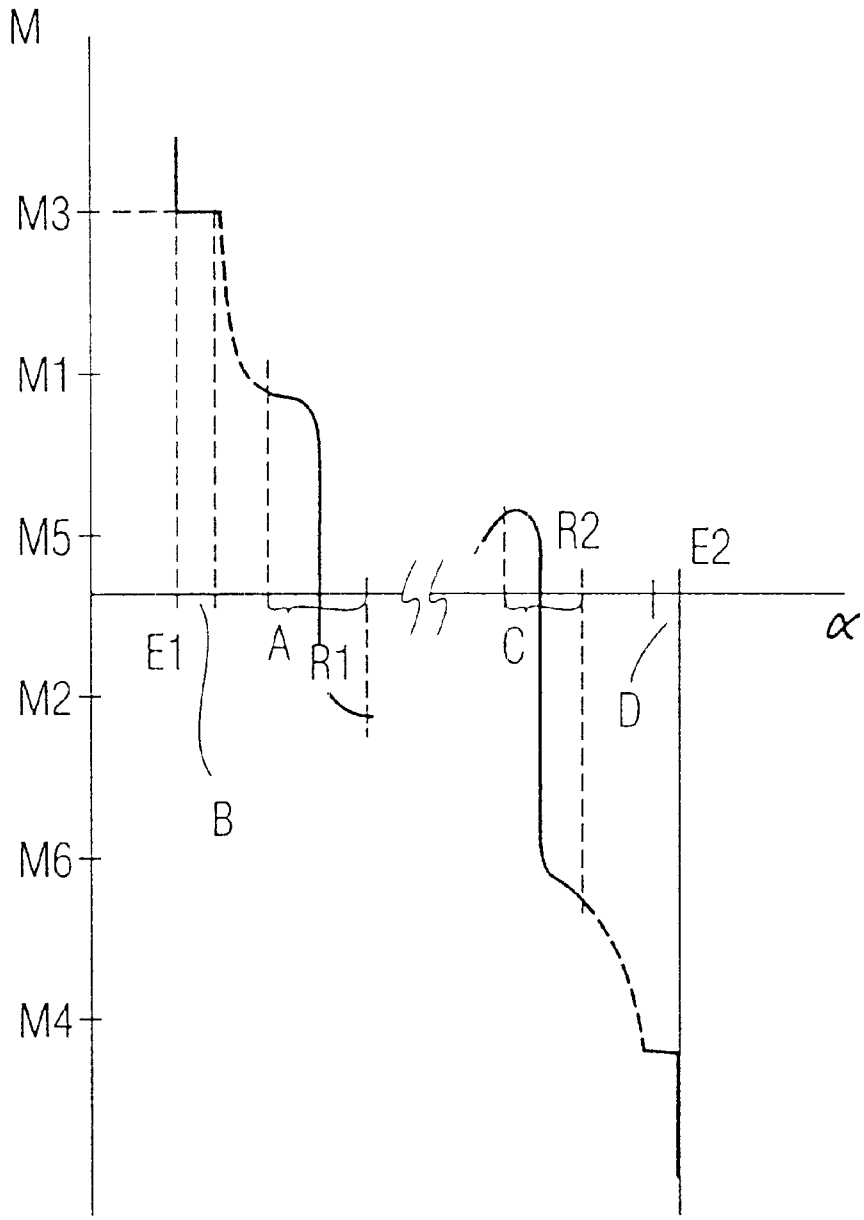
FIG. 6 is a diagram showing the resetting torques, applied to the latch of the latch needle illustrated in FIGS. 1–5, as a function of the pivotal position of the latch.
Figure 7:
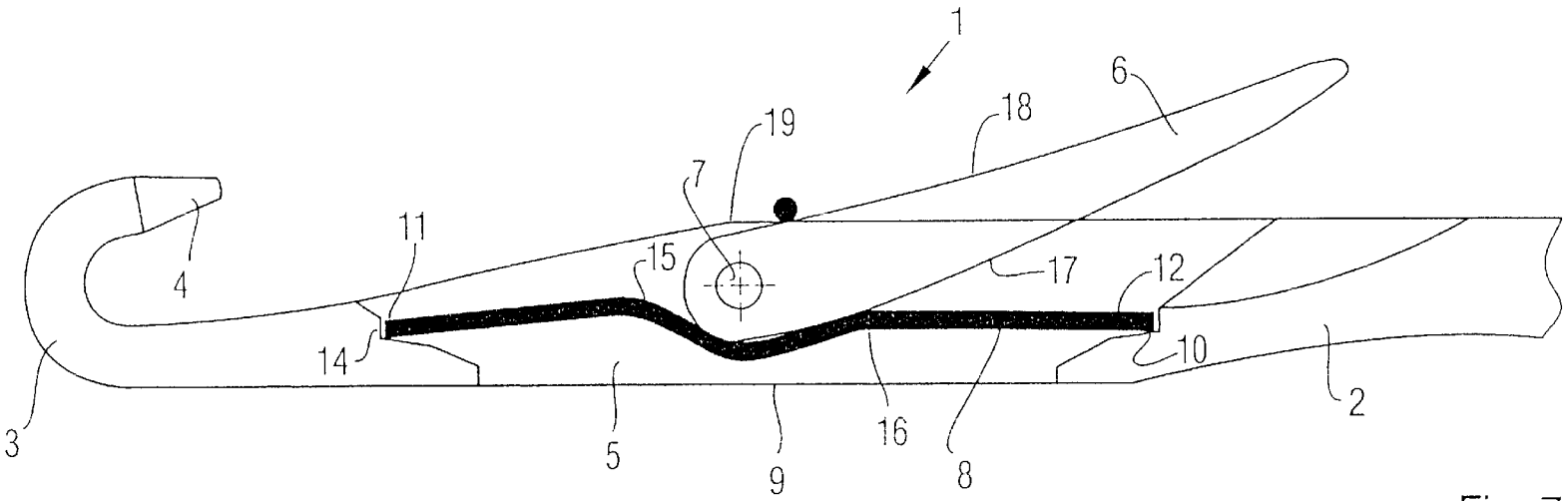
Fig. 7 (PRIOR ART)
FIGS. 7 and 8 are fragmentary sectional side elevational views of a latch needle according to the prior art, illustrating, respectively, positions of the rest of the latch.
Figure 8:
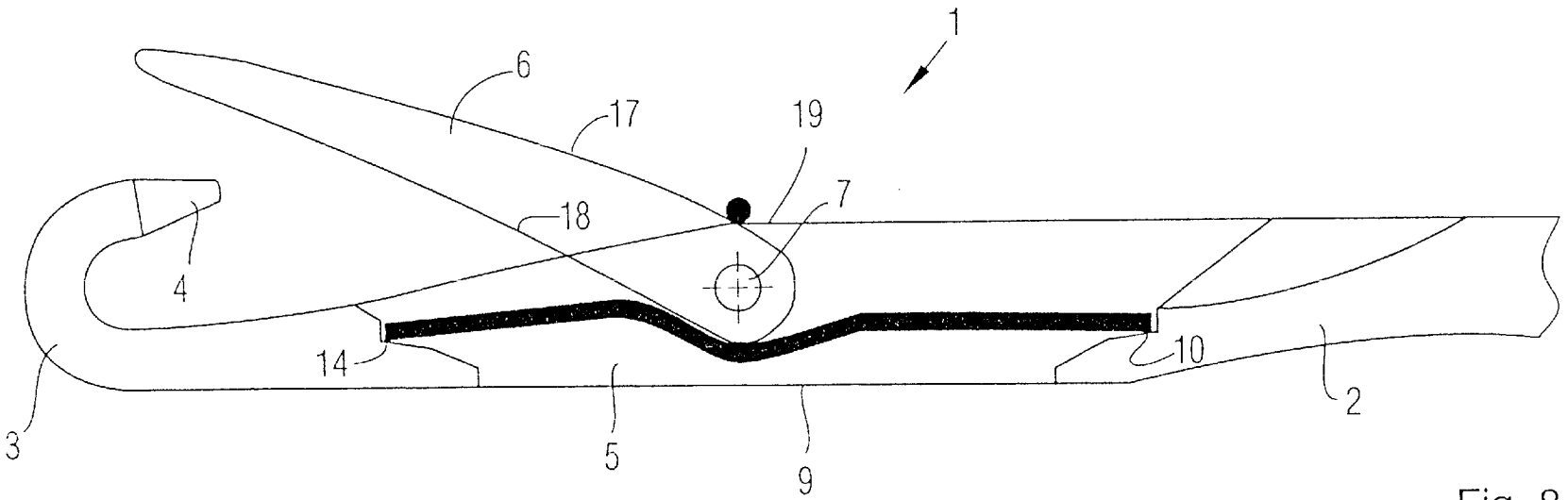
Fig. 8 (PRIOR ART)

Also referring to FIG. 6, the spring 8, in cooperation with the latch 6, generates a resetting torque M which maintains the latch 6 in its position of rest R1. When the latch 6 dwells in its position of rest R1, no torque is applied thereto. Even the smallest excursion of the latch 6 from its position of rest R1, however, generates a resetting torque M1 or M2, opposing the excursion of the latch 6. The resetting torques M1, M2 generated upon excursions or latch 6 in the one or the other direction may be of different magnitude, dependent, for example, on whether the angles W1, W2 equal or differ from one another.

If the latch 6 is moved from its position of rest R1 in the direction of the hook tip 4, it leaves the holding range determined by the engagement face 24 and the pressing face 27 for the position of rest R1 and reaches its end position E1. In this position the engagement face 22 and the pressing face 15 of the spring 8 are in contact with one another, as may be observed in FIG. 1 in which a thread 30 belonging to a loop presses the latch 6 against the hook tip 4. In the end position E1 the pressing face 22 exerts its force on the latch 6 with a relatively long lever arm which, in any event, is longer than the lever arm of pressing face 27. Accordingly, as seen in FIG. 6, a comparatively larger resetting torque M3 is generated. Such a torque, however, is effective only through a small pivotal range B of the latch 6, shortly before it arrives into engagement with the hook end 4.

The engagement face 22 is designated as a "second engagement face" and the flexing location 15 of the spring 8 is designated as a "second pressing face". The pivotal range in which the second engagement face 22 and the second pressing face 15 become effective is designated as a region B in FIG. 6. The region in which the first engagement face 24 and the first pressing face 27 become effective is designated at A in FIG. 6. The pivotal ranges A and B may be of different size; in the example illustrated the pivotal range A is greater than the pivotal range B.

The course of the resetting torque with respect to the second end position E2 and the second position of rest R2 is set in a similar manner. The engagement face 23 and the pressing face 26 respectively form a "third engagement face" and a "third pressing face" which defines a pivotal region C with resetting torques M5, M6 as shown in FIG. 6. The pivotal region C may be greater, equal to or smaller than the pivotal range A or the pivotal range B.

The pressing face formed by the flexing location 16 and the engagement face 21 respectively form a "fourth pressing face" and a "fourth engagement face" which, in a pivotal zone D, generate a resetting torque M4 in the vicinity of the end position E2, as shown in FIG. 6.

The resetting torques M3, M4 may be set independently from the resetting torques M1, M2; M5, M6 and thus may be greater, equal to or smaller than the latter. In particular, between the pivotal ranges B and A as well as between the pivotal ranges C and D an intermediate region may be present in which no appreciable resetting torque prevails or where a small resetting torque is generated. This may be achieved by providing, for example, that the flexing locations 15, 16 of the spring 8 arrive into engagement with the latch 6 only when the latch 6 is closer to the respective end position E1, E2 than the respective position of rest R1, R2. At a result, the latch 6 is not launched forcefully from its respective end position E1 or E2 to thus ensure that the latch 6 reaches securely its position of rest R1 or R2 and does not overshoot such positions.

Assuming a direction of motion of the thread 30 as indicated by the arrow 31 in FIG. 2 during the knitting process, as soon as the thread 30 runs up on the inner side 18 of the latch 6, it moves the latch 6 out of its position of rest R1. As indicated in FIG. 6, the generated resetting torque M2 acting against such a latch-moving force is preferably small and thus smaller thus the resetting torque M1 working in the opposite direction. This may be achieved by arranging the engagement face 24 asymmetrically offset relative to the bearing pin 7. Thus, in FIG. 2 the engagement face 24 is offset toward the left with respect to the bearing pin 7 so that it overlaps the bearing pin 7 towards the right only to a very small extent. Towards the left, however, the engagement face 24 does overlap the bearing pin 7.

The thread 30 running in the direction of the arrow 31 moves the latch 6 out of its position of rest R1 and pivots the same first in the direction of its reverse end position E2. The latch 6 thus first arrives into its position shown in FIG. 3, that is, into its position of rest R2. In this position the pressing face 26 of the spring 8 pushes against the engagement face 23 of the latch 6. If now the loop formed by the thread 30 continues to run in the direction of the arrow 32 as shown in FIG. 3, the thread 30 gradually arrives into its position shown in FIG. 4. Because of the greater distance to the pivot axis 7*a,* the thread 30 may produce with relatively small tensions a pivotal torque which is greater than the relatively small resetting torque M6 which is produced by the face pair composed of the engagement face 23 and the pressing face 26. Thus, the latch 6 is pressed into its end position E2 shown in FIG. 4 or into a position in the region D, as shown in FIG. 6. Therefore, the loop is expanded only at a significantly later moment during its motion, and such a loop expansion is significantly smaller than in conventional latch needles. The duration of the loop expansion is significantly shortened, as a result of which such as expansion has no lasting effect. The pressing face 16 and the engagement face 21 generate a relatively large counter torque M4 only in a very short pivotal range. The thread 30, however, exerts its force with a longer arm and therefore may generate a torque for overcoming the resetting torque M4 without a lasting enlargement of the loop.

The latch needle 1 starts its reverse motion when the thread 30 has glided from the latch 6 downwardly onto the shank 2. During this occurrence the latch 6 is in its position of rest R2. The thread 30 exerts a torque on the latch 6 as soon as the thread 30 contact the outer latch edge 17. This torque is sufficient to overcome the small holding torque M5 (FIG. 6) generated by the engagement face 23 and the pressing face 26 and to pivot the latch 6 back into its position of rest R1. Then, as the thread 30, as shown in FIG. 1, glides on the outer edge 17 of the latch 6 further in the direction of the latch spoon, the thread 30, by virtue of the tension of the formed loop, moves the latch 6 out of its position of rest R1 and first overcomes the relatively small holding torque M1 and then, in a delayed second step, overcomes the resetting torque M3. The loop formed by the thread 30 is thus knocked over at the hook of the latch needle without a lasting loop enlargement. During this occurrence the latch 6 reaches the pivotal region B shown in FIG. 6 and assumes a position at or in the region B. During this occurrence the loop is not lastingly enlarged for gliding over the latch 6 which dwells in the position of rest R1; rather, a slight thread tension suffices to move the latch 6 into the end position E1 or into its vicinity.

Although the positions of rest R1, R2 are set only with small resetting forces, a reliable lifting of the latch 6 off its end positions E1, E2 is ensured by the resetting torques M3, M4 which, however, are effective only through small pivotal ranges B, D.

Thus, the latch needle 1 according to the invention has a spring 8 which serves to immobilize the latch 6 in one or two stable positions of rest R1, R2 and further, to move the latch 6 out of a respective end position E1, E2. The latch 6 and the spring 8 are so configured that in the end positions E1, E2 and in the positions of rest R1, R2 different resetting torques may be applied. In the end positions E1, E2 the resetting torques are generated and applied to the latch 6 by different pressing face regions 15, 16 and engagement faces 21, 22 as compared to the positions of rest R1, R2. In the end positions E1, E2 the resetting torques M3, M4 are generated by the contact of the inner edge 18 or the outer edge 17 of the latch 6 with the spring 8. The resetting torques M1, M2, M5 and M6 in the positions of rest R1, R2 are generated by the cooperation between the pressing faces 26, 27 of the spring 8 with the engagement faces 23, 24 of the end of the latch shank, containing the bearing bore 25.

It will be understood that the above description of the present invention is susceptible to various modifications, changes and adaptations, and the same are intended to be comprehended within the meaning and range of equivalents of the appended claims.

What is claimed is:

1. A latch needle comprising (a) a needle shank;

(b) a hook formed at one end of said needle shank;

(c) a saw slot formed in said needle shank adjacent said hook;

(d) a latch supported in said saw slot for pivotal motion about a pivot axis; said latch having first and second end positions and a position of rest situated between said first and second end positions adjacent one of said end positions; said latch having first and second engagement faces spaced from one another;

(e) a spring situated in said saw slot; said spring having first and second opposite ends; said spring including (1) a first pressing face being in contact with said first engagement face when said latch is in said position of rest; and (2) a second pressing face spread from said first pressing face and being in contact with said second engagement face when said latch is in the end position adjacent said position of rest; and (f) first and second seats provided in said saw slot for supporting for respectively supporting said first and seconds ends of said spring.

2. The latch needle as defined in claim 1, wherein said first pressing face and said first engagement face are out of contact with one another when said latch is in said end position adjacent said position of rest; and further wherein said second pressing face and said second engagement face are out of contact with one another when said latch is in said position of rest.

3. The latch needle as defined in claim 1, wherein said first engagement face is at a lesser distance from said pivot axis than said second engagement face.

4. The latch needle as defined in claim 1, wherein said first engagement face and said pivot axis define a triangle whose inner angles adjoining said first engagement face are acute angles.

5. The latch needle as defined in claim 1, wherein said second pressing face and said second engagement face contact one another solely when said latch is situated between said position of rest and said end position adjacent said position of rest.

6. The latch needle as defined in claim 1, wherein said first engagement face is planar.

7. A latch needle comprising (a) a needle shank;

(b) a hook formed at one end of said needle shank;

(c) a saw slot formed in said needle shank adjacent said hook;

(d) a latch supported in said saw slot for pivotal motion about a pivot axis; said latch having open and closed end positions and a position of rest situated between said open and closed end positions adjacent said closed end position; in said closed end position said latch being in engagement with said hook and in said open end position said latch being in engagement with said shank at a location spaced from said hook; said latch having first and second engagement faces spaced from one another; and (e) a spring situated in said saw slot; said spring having (1) a first pressing face being in contact with said first engagement face when said latch is in said position of rest;

(2) means for exerting a resetting torque on said latch upon movement thereof in either pivotal direction out of said position of rest for stabilizing said latch in said position of rest; and (3) a second pressing face spread from said first pressing face and being in contact with said second engagement face when said latch is in said closed end position.

8. The latch needle as defined in claim 7, wherein said first pressing face and said first engagement face are out of contact with one another when said latch is in said closed end position; and further wherein said second pressing face and said second engagement face are out of contact with one another when said latch is in said position of rest.

9. The latch needle as defined in claim 7, wherein said first engagement face is at a lesser distance from said pivot axis than said second engagement face.

10. The latch needle as defined in claim 7, wherein said first engagement face and said pivot axis define a triangle whose inner angles adjoining said first engagement face are acute angles.

11. The latch needle as defined in claim 7, wherein said second pressing face and said second engagement face contact one another solely when said latch is situated between said position of rest and said closed end position.

12. The latch needle as defined in claim 7, wherein said first engagement face is planar.

13. A latch needle comprising (a) a needle shank;

(b) a hook formed at one end of said needle shank;

(c) a saw slot formed in said needle shank adjacent said hook;

(d) a latch supported in said saw slot for pivotal motion about a pivot axis; said latch having first and second end positions and a position of rest situated between said first and second end positions adjacent one of said end positions; said latch having first and second engagement faces spaced from one another; and (e) a spring situated in said saw slot; said spring having (1) a first pressing face being in contact with said first engagement face when said latch is in said position of rest; and (2) a second pressing face spaced from said first pressing face and being in contact with said second engagement face when said latch is in the end position adjacent said position of rest; said spring, said first and second engagement faces and said first and second pressing faces being dimensioned and positioned such that in said end position of said latch adjacent said position of rest, said spring applies a resetting torque to said latch that is greater than a resetting torque applied to said latch when in said position of rest.

14. A latch needle comprising (a) a needle shank;

(b) a hook formed at one end of said needle shank;

(c) a saw slot formed in said needle shank adjacent said hook;

(d) a latch supported in said saw slot for pivotal motion about a pivot axis; said latch having first and second end positions and a first position of rest situated between said first and second end positions adjacent said first end position; said latch having first, second, third and fourth engagement faces spaced from one another; said latch further having a second position of rest situated between said first position of rest and said second end position and being adjacent said second end position; and (e) a spring situated in said saw slot; said spring having (1) a first pressing face being in contact with said first engagement face when said latch is in said position of rest;

(2) a second pressing face spaced from said first pressing face and being in contact with said second engagement face when said latch is in the end position adjacent said position of rest; and (3) third and fourth pressing faces cooperating with respective said third and fourth engagement faces for determining said second position of rest.

15. The latch needle as defined in claim 14, wherein said first and third pressing faces of said spring at least partially overlap one another.

16. A latch needle comprising (a) a needle shank;

(b) a hook formed at one end of said needle shank;

(c) a saw slot formed in said needle shank adjacent said hook;

(d) a latch supported in said saw slot for pivotal motion about a pivot axis; said latch having first and second end positions and a position of rest situated between said first and second end positions adjacent one of said end positions; said latch having first and second engagement faces spaced from one another; and (e) an elongated flexion spring situated in said saw slot; said spring having a length and a thickness and including (1) a first pressing face being in contact with said first engagement face when said latch is in said position of rest; said first pressing face having a length measured along said length of said spring; said length of said first pressing face being at least twice said thickness and (2) a second pressing face spaced from said first pressing face and being in contact with said second engagement face when said latch is in the end position adjacent said position of rest; said second pressing face having a length measured along said length of said spring; said length of said second pressing face being at least twice said thickness.

* * * * *